United States Patent [19]

Foy

[11] Patent Number: 4,923,079

[45] Date of Patent: May 8, 1990

[54] COLLAPSIBLE CONTAINER

[75] Inventor: Dennis M. Foy, Birmingham, Mich.

[73] Assignee: Ropak Corporation, Fullerton, Calif.

[21] Appl. No.: 403,064

[22] Filed: Sep. 1, 1989

Related U.S. Application Data

[63] Continuation of Ser. No. 328,749, Mar. 22, 1989, abandoned, which is a continuation of Ser. No. 22,996, Mar. 6, 1987, abandoned.

[51] Int. Cl.[5] ..... B65D 7/24

[52] U.S. Cl. ..... 220/7; 220/326

[58] Field of Search ..... 220/1.5, 6, 7, 326, 220/72

[56] References Cited

U.S. PATENT DOCUMENTS

| | | | |
|---|---|---|---|
| 2,936,189 | 5/1960 | Pearson | 220/326 X |
| 4,320,845 | 3/1982 | Waller | 220/7 X |
| 4,591,065 | 5/1986 | Foy | 220/7 |
| 4,600,278 | 7/1986 | Saito | 220/326 X |
| 4,674,647 | 6/1987 | Gyenge et al. | 220/1.5 X |
| 4,715,508 | 12/1987 | Schurch | 220/7 |
| 4,735,331 | 4/1988 | Keenan et al. | 220/7 X |

*Primary Examiner*—Steven M. Pollard

*Attorney, Agent, or Firm*—Reising, Ethington, Barnard, Perry & Milton

[57] ABSTRACT

A foldable container assembly (10) includes a base (12) having a plurality of sides (14, 16, 18, 20). A wall hinge (24) interconnects each of the side walls (14, 16, 18, 20) to the base (12) with the wall hinge (24) for a first side wall (14) being in a vertically spaced horizontal plane from the wall hinge (24) for a second side wall (16) for folding the first and second side walls (14, 16) over the base (12) and into overlapping vertically spaced relationship to one another. The base (12) is generally convex and includes a rigid top member (80) and a corner support element (86) near each corner of the top member (80), perimeter support element (88) near the perimeter of the top member (80) about midway between adjacent pairs of corner support elements (86), and a center support element (90) near the center of the top member (80). The corner support element (86) and the perimeter support elements (88) define a pair of forked channels for receiving and guiding the forks of a forked lift for mechanically raising and lowering the container assembly (10). A strip member (94) interconnects the corner (86), perimeter (88) and center (90) support element to form a bottom member. The strip member (94) includes a flange (96) along one edge thereof extending downwardly and outwardly from the strip member (94) for abutting the interior edge of the side walls (14, 16, 18, 20) in the vertical position for vertically stacking the container assemblies (10) one upon another.

11 Claims, 7 Drawing Sheets

COLLAPSIBLE CONTAINER

This application is a continuation of application Ser. No. 328,749, filed Mar. 6, 1987, now abandoned, which is a continuation of 022,996 filed Mar. 22, 1989, now abandoned.

TECHNICAL FIELD

The invention relates to containers of the type used for packaging and shipping goods in bulk and is collapsible to reduce the space required for them to be shipped after use by stacking the empty compacted containers.

BACKGROUND ART

Durable collapsible or foldable container assemblies have been used by the shipping and packaging industries. An example of such containers is disclosed in U.S. Pat. No. 4,591,065 to Dennis M. Foy. This foldable container includes a molded plastic base having four side walls extending vertically upward from each side of the base. The walls are vertically spaced for folding one side wall over the base and another side wall over the former one and into overlapping vertical spaced relationship to one another. The hinges on two of the side walls have an associated link having slots therein for allowing the side wall to move vertically relative to the base for locking and unlocking the walls from one another. Also, the tops of the side walls have projections for coacting with legs extending from the base to relatively position and stack the containers one upon another.

The deficiency in such containers is that the base only has legs extending downwardly and outwardly from it, and no means is provided for guiding the forks of a forked lift into the base for raising and lowering the container assembly. Moreover, the tops of the side walls must include a projection which coacts with the legs to stack the container assembly on the tops of the side walls only.

STATEMENT OF THE INVENTION AND ADVANTAGES

A foldable container assembly includes a base having a plurality of sides, at least one side wall extending vertically upwardly from each side of the base with the tops of the side walls all being aligned in a horizontal plane. A wall hinge means interconnects each of the side walls to the base with the wall hinge means for a first side wall being in a vertically spaced horizontal plane from the wall hinge means for a second side wall for folding the first and second side walls over the base and into overlapping vertically spaced relationship to one another. The assembly is characterized by the base being generally convex and including a rigid top member and a support means connected to the top member for supporting the top member upon a support surface and defining channels therein to accommodate a lifting means in the openings and for guiding the lifting means into the openings and for inserting the base within the opening of another assembly formed by the side walls in the vertical position to allow vertical stacking of the container assemblies one upon another.

Accordingly, the subject invention includes a means for defining channels and guiding the forks of a lifting means into the channels. The subject invention allows the base of the container assembly to be inserted partially within the opening formed by the side walls in the vertical position of another assembly to allow vertical stacking of the container assemblies upon one another.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
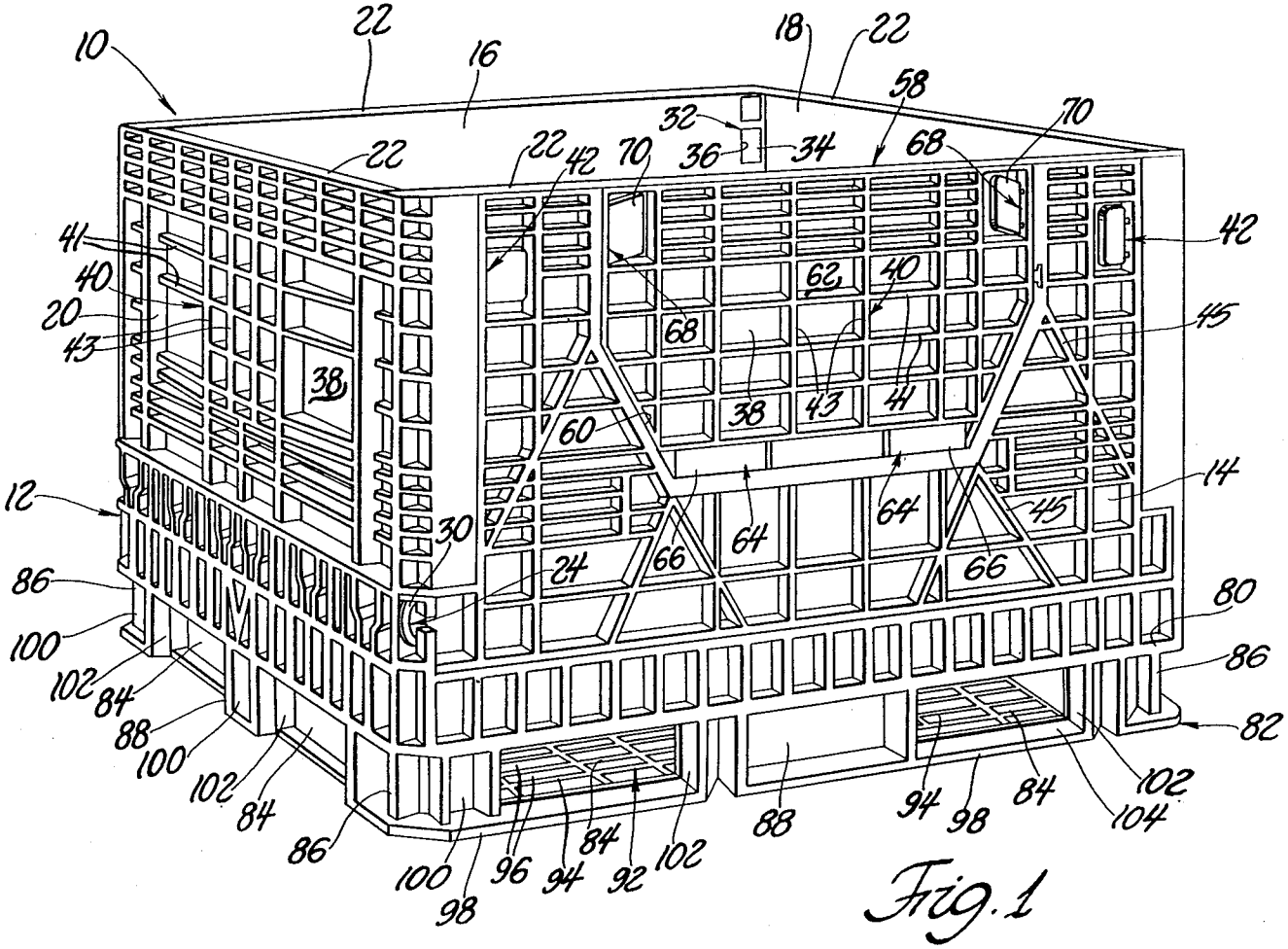
FIG. 1 is a perspective view of the container with the walls in a vertically locked position.

A foldable or collapsible container assembly is generally shown at 10 in FIG. 1. The 12, assembly 10 includes a base, generally indicated at and a plurality of sides or side walls 14, 16, 18, 20 with at least one side wall 14, 16, 18, 20 extending vertically upwardly from each side of the base 12. The tops 22 of the side walls 14, 16, 18, 20 are all aligned in a horizontal plane as shown in FIG. 1. The assembly 10 includes wall hinge means, generally indicated at 24, interconnecting each of the side walls 14, 16, 18, 20 to the base 12 with the wall hinge means 24 for a first side wall 14, being in a vertically spaced horizontal plane from the wall hinge means 24 for a second side wall 16 for folding the first 14 and second 16 side walls over the base 12 and into overlapping vertically spaced relationship to one another.

Figure 7:
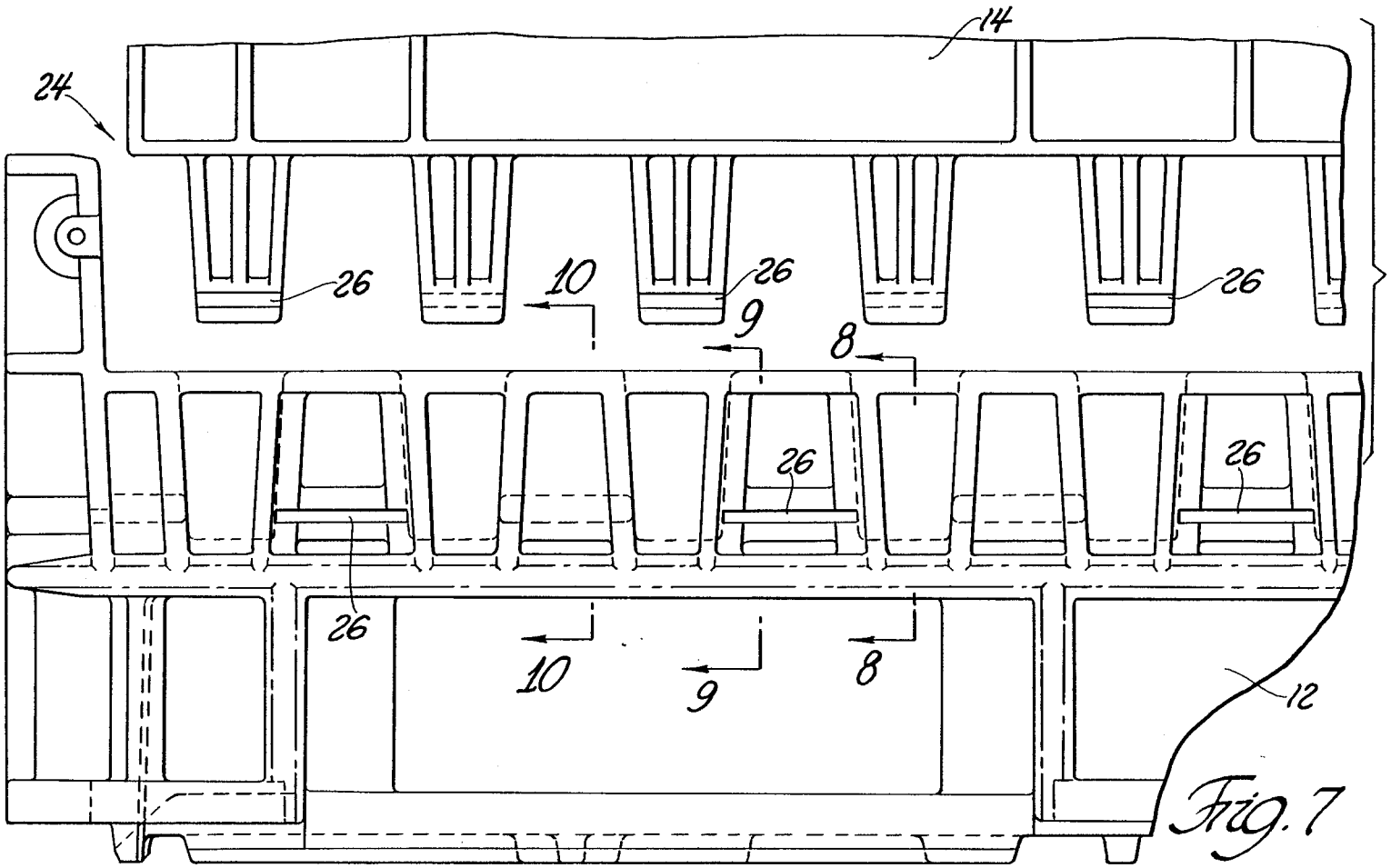
FIG. 7 is an enlarged exploded view of the hinge means illustrating the interaction of the tongue and groove hinge.
Figure 8:
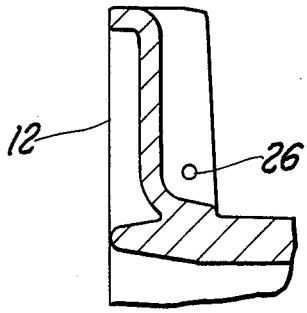
FIG. 8 is a cross-sectional view take substantially along lines 8—8 of FIG. 7.
Figure 9:
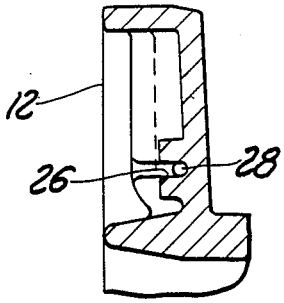
FIG. 9 is a cross-sectional view taken substantially along lines 9—9 of FIG. 7.
Figure 10:
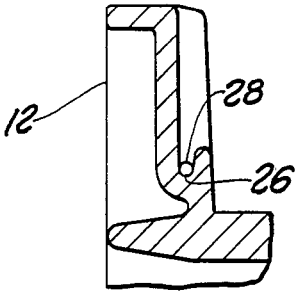
FIG. 10 is a cross-sectional view taken substantially along lines 10—10 of FIG. 7.

The wall hinge means 24 includes a series of tongue and grooves along the bottom edge of the side wall 14, 16, 18, 20 and the top edge of the base 12 wherein the tongues of the side wall 14, 16, 18, 20 are disposed in the grooves of the base 12 and visa versa, as shown in FIG. 7. The wall hinge means 24 further includes a series of hinge holes or apertures 26 along the bottom edge of the side wall 14, 16, 18, 20 and the top edge of the base 12 in the tongue and groove arrangement. A rod 28 is disposed in the apertures 26 of the side wall 14, 16, 18, 20 and the base 12 and has a lock washer 30 on each end thereof to secure the tongues in the grooves and to allow pivotal movement of the side wall 14, 16, 18, 20 relative to the base 12. In other words, a rod 28 is disposed in a series of apertures 26 along the bottom edge of the side wall 14, 16, 18, 20 and the top edge of the base 12 to allow pivotal movement of the side wall 14, 16, 18, 20 relative to the base 12. The rod 28 may be a protruded fiber glass rod with a resin-enriched surface. The resin-enriched surface of the rod prolongs the life of the rod and prevents wear. The rod 28 is essentially unbreakable and is capable of sustaining substantial deformation without failure. As disposed in the hinge means 24, however, the rod 28 resists deformation because the stresses applied to it are isolated due to the tongue and groove arrangement. In other words, each tongue may apply a stress from internal or external forces only over a small cross section of the rod 28. The rod 28 resists the stresses over a small cross section and is substantially rigid as disposed in the hinge means 24. This adds strength to the hinge. Further, the tongue and groove of the hinge means 24 is arranged such that the thickness of the hinge means 24 at the base 12 is greater than the thickness of the hinge means 24 at the side wall 14, 16, 18, 20. More specifically, the tongue and groove of the base 12 may be as much as twice as thick or more than the tongue and groove of the side wall 14, 16, 18, 20. This arrangement is much stronger than previous hinges employed in collapsible containers and transforms an area of weakness into a strength. FIGS. 8, 9 and 10 illustrate the relationships between the apertures 26 in the base 12 and the rod 28 at various points along the tongue and groove hinge means 24.

Figure 3:
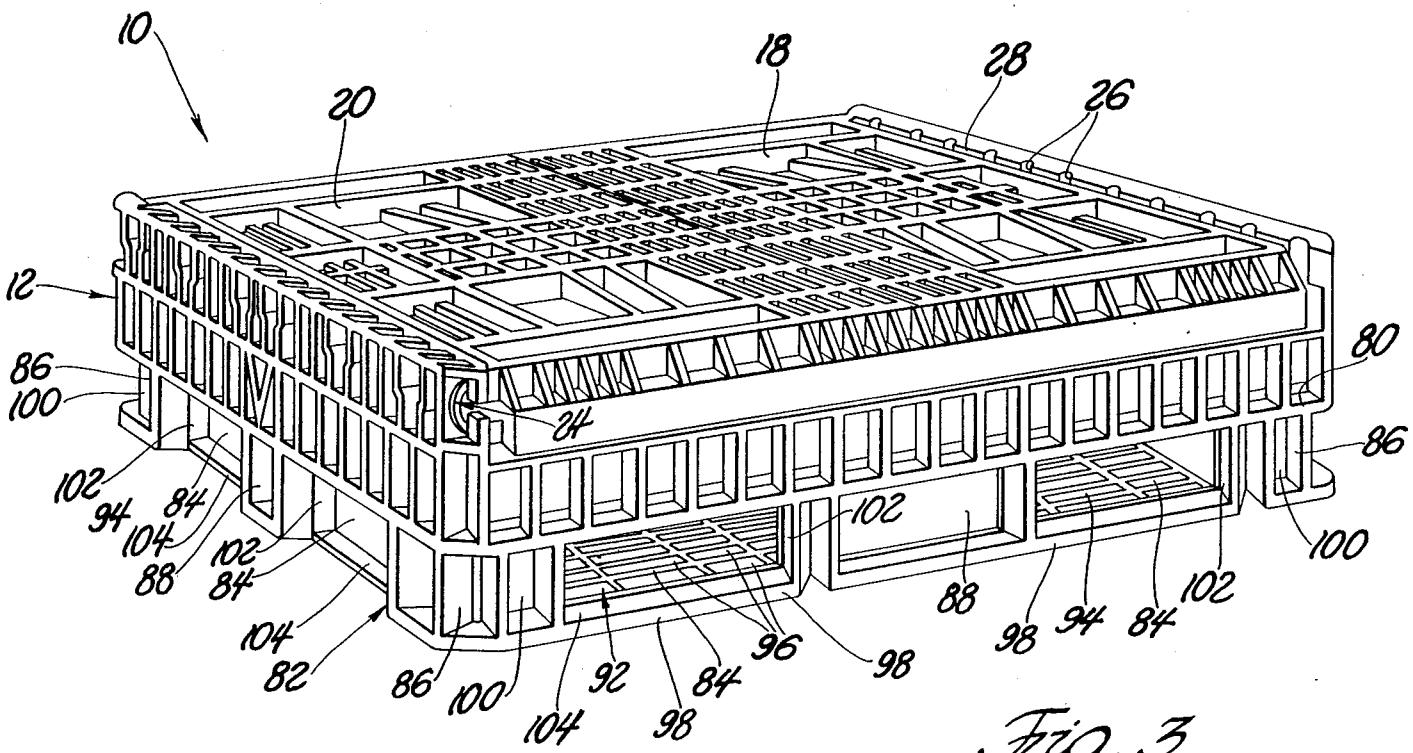
FIG. 3 is a perspective view of the folded container taken from substantially the same angle as FIG. 2.

The wall hinge means 24 for the first 14 and second 16 side walls lie in vertically spaced horizontal planes, whereas the wall hinge means 24 for the third 18 and fourth 20 of the side walls are in the same horizontal plane above the horizontal plane of the wall hinge means 24 for the second side wall 16. The third and fourth side walls 18, 20 extend from their associated hinge means 24 to the tops 22 thereof a distance less than one half the distance between the wall hinge means 24 for the third and fourth side walls 18, 20. That is to say, the opposing side walls 18 and 20 do not overlap when folded downward, instead lying flat on top of the folded walls 14 and 16 as illustrated in FIG. 3.

Figure 2:
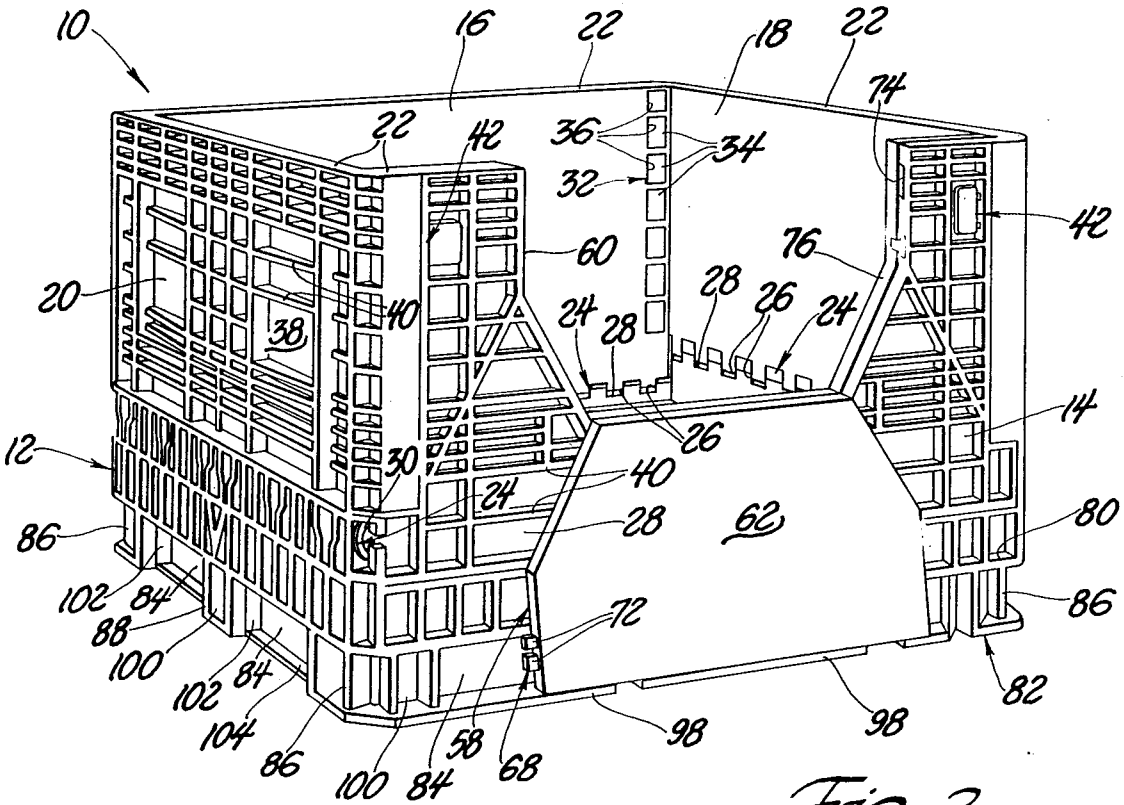
FIG. 2 is a perspective view wherein a door in the first wall has been unlocked and folded outward.

The assembly 10 includes interconnecting means, generally indicated at 32, for releaseably interconnecting the side edge of each side wall 14, 16, 18, 20 to the side edge of the adjacent side wall when in the vertical position. As illustrated in FIG. 2, the interconnecting means 32 includes a plurality of vertically spaced lugs 34 disposed along one edge of one side wall and a lug receiving openings 36 disposed along the adjacent edge of the adjacent side wall opposite the spaced lugs 34. In operation, the side walls 18, 20 are raised to the vertical position and on either side wall 14 or 16 is directly pivotally rotated about the axis of the rod 28 of the wall hinge means 24 to the vertical position where the lug receiving openings 36 engage the spaced lugs 34. In other words, the side walls 14, 16, 18, 20 are pivoted from the folded position on the base 12 about the axis of the rod 28 to the vertical position and vice versa.

The side walls 14, 16, 18, 20 have planar interior sheets 38 with ribs generally indicated at 40 extending outwardly therefrom and in spaced relationship with respect to each other. The ribs 40 are disposed closer to one another at the tops 22 of the side walls 14, 16, 18, 20 and at the base 12 to provide greater support to the side walls, 14, 16, 18, 20 near these areas. More specifically, the ribs 40 include horizontal ribs 41 and vertical ribs 43. The horizontal ribs 41 are disposed vertically closer together at the tops 22 and at the base 12 and spaced further apart from one another near the middle of the side walls 14, 16, 18, 20. The vertical ribs 43 are disposed horizontally closer together at the tops 22 and at the base 12 and spaced further apart from one another near the middle of the side walls 14, 16, 18, 20. Further, a side wall 14, 16, 18, 20 may include diagonal ribs 45 extending diagonally across a portion of the walls 14, 16, 18, 20. Together, the ribs 40, 41, 43 and 45 form a support matrix for providing greater support at the tops 22 of the side walls 14, 16, 18, 20 and near the base 12 of the container assembly 10 and insures the structural integrity of the assembly 10 under various loading stresses.

Figure 4:
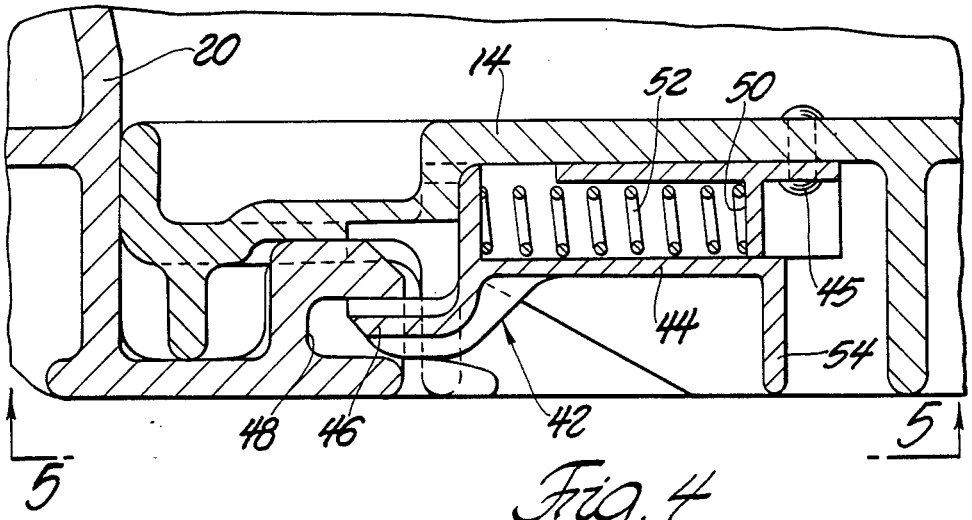
FIG. 4 is an enlarged plan view of the wall locking means with adjacent side walls locked in the vertical position.
Figure 5:
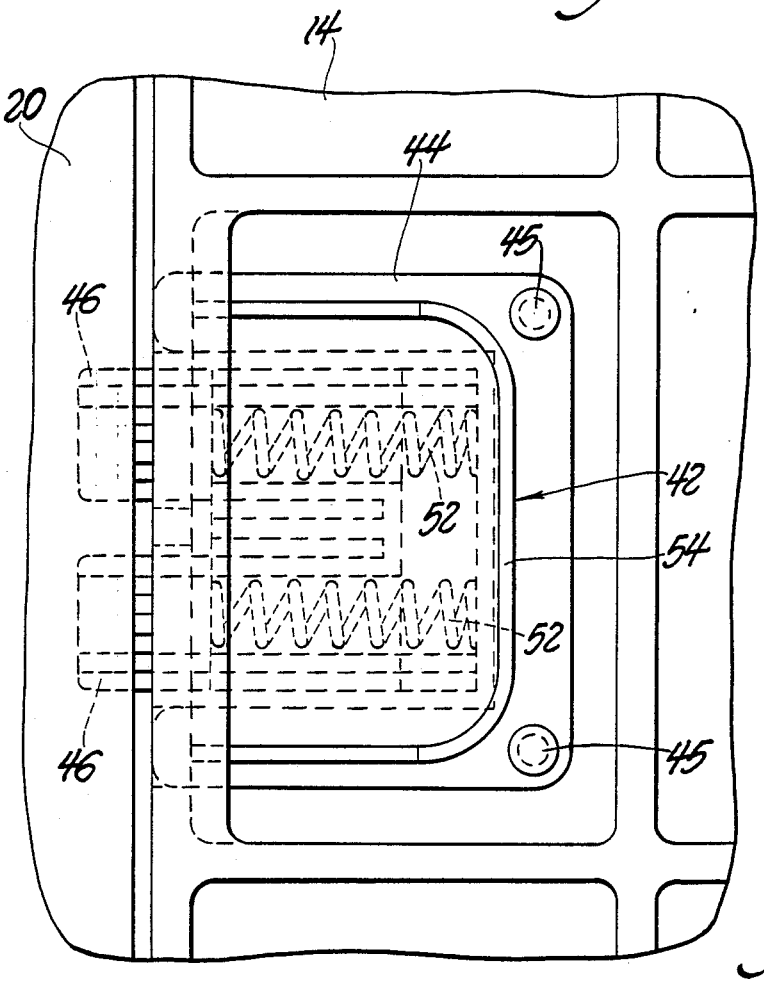
FIG. 5 is an enlarged elevational view of the wall locking means in the locked position.
Figure 6:
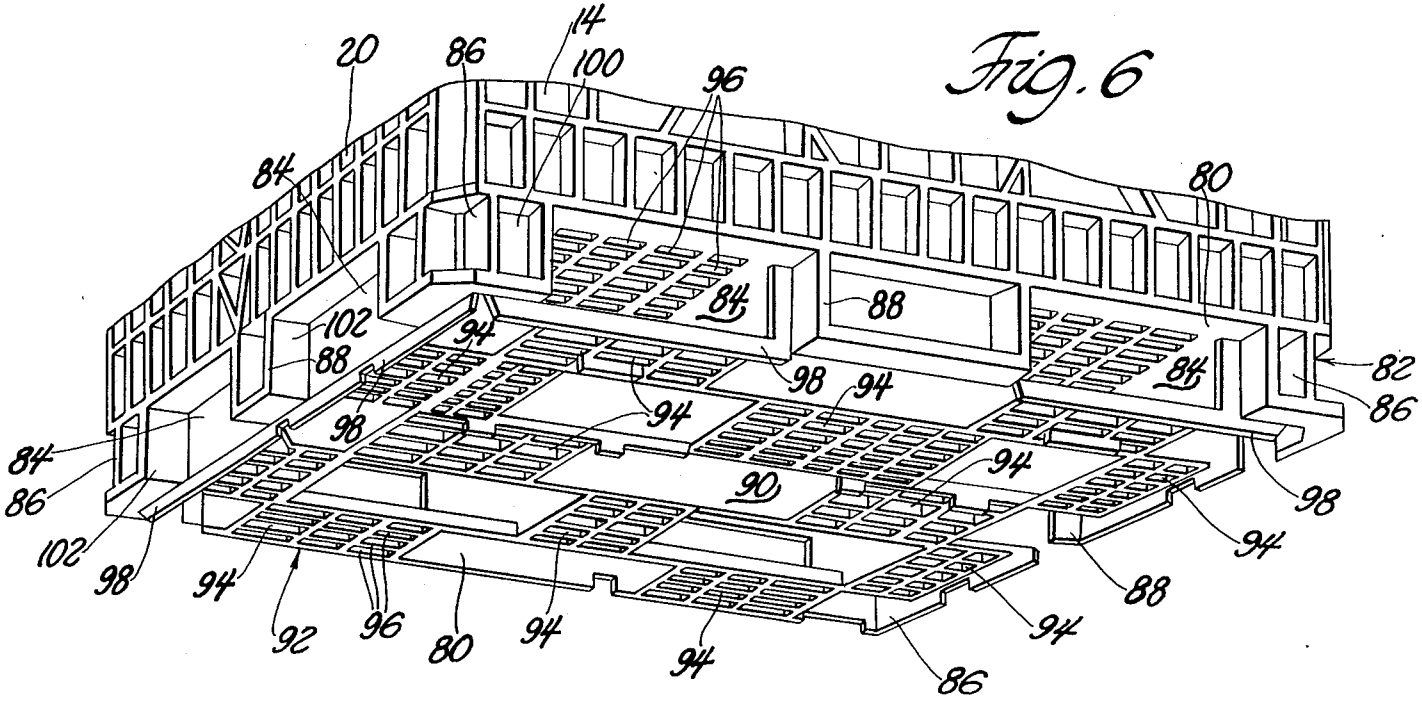
FIG. 6 is a perspective view of the underside of the base for stacking the container.

The assembly 10 includes wall locking means generally indicated at 42, for releaseably locking the side edge of each side wall 14, 16, 18, 20 to the side edge of the adjacent side wall when in the vertical position. As illustrated in FIGS. 4 and 5, the wall locking means 42 includes a latch member 44 connected to at least one edge of the side wall 14, 16, 18, 20 by a fastening means such as welds 45 and having a projection 46 extending outwardly from one side thereof. Preferably, the side walls 14, 16, include a latch member 44 connected to both edges or sides of the side walls 14, 16. The wall locking means 42 includes a longitudinal groove or slot 48 along the edge of an adjacent side wall opposite the projection 46 of the latch member 44. Preferably, the side walls 18, 20 include a longitudinal groove 48 along each side edge of the side walls 18, 20. The latch member 44 also includes a cavity portion 50. A biasing means 52 is disposed in the cavity portion 50 of the latch member 44 for biasing the projection 46 of the latch member 44 into engagement and disengagement with the groove 48. The biasing means 52 comprises a spring 52. The latch member 44 further includes a flange 54 acting as a handle to allow a person to manually actuate the latch member 44 by hand. In operation, the latch member 44 is slideably moved by engaging the flange 54 and moving the latch member 44 along the side wall 14, 16 in a plane substantially parallel to the side wall 14, 16 to move the projection 46 into engagement and disengagement with the groove 48 of the adjacent side wall 18, 20. This is known in the art as a "slam latch".

The assembly 10 further includes a door means, generally indicated at 58, disposed in an opening 60 in at least one of the side walls 14, 16, 18, 20 for opening and closing the opening 60 to allow access to the inside of the container assembly 10 through the side walls 14, 16, 18, 20 when the side walls 14, 16, 18, 20 are in the vertical position. In other words, when the container assembly 10 is stacked one upon another, the door means 58 disposed in the opening 60 of the side wall 14, 16, 18, 20 allows access to the inside of the container assembly 10 through the side walls 14, 16, 18, 20 when the side walls 14, 16, 18, 20 are in the vertical position. The door means 58 includes a door 62 disposed within the opening 60 of the side wall 14, 16, 18, 20 and a door hinge means, generally indicated at 64, connected to one, preferably the bottom, edge of the door 62 and the adjacent edge, preferably the bottom, of the opening 60 for allowing pivotal movement of the door 62 relative to the side wall 14, 16, 18, 20.

The door hinge means 64 includes a flexible C-shaped member 66 to allow the door 62 to pivot outwardly with respect to the side wall 14, 16, 18, 20 as illustrated in FIG. 2. In other words, the flexible C-shaped member has one 66 flange connected to the bottom of the opening 60 and the other flange connected to the bottom of the door 62 to allow the door 62 to be pivotally rotated from a closed position within the side wall 14, 16, 18, 20 to an open position outwardly from the container assembly 10. When the door 62 is in the fully open position, it extends downwards in a vertical plane which is adjacent the vertical plane of the side wall, 14, 16, 18, 20. When the door 62 is in the fully open position, it extends downwardly in a vertical plane which is adjacent the vertical plane of the side wall 14, 16, 18, 20.

Figure 11:
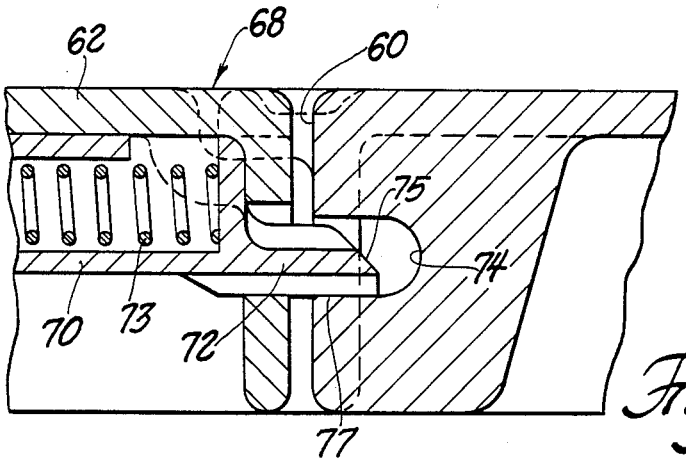
FIG. 11 is an enlarged top plan view of the door locking means with the door locked in the vertical closed position.

The assembly 10 includes a door locking means, generally indicated at 68, for releaseably engaging the door 62 with the side wall 14, 16, 18, 20 in a locked condition to prevent pivotal movement of the door 62 relative to the side wall 14, 16, 18, 20 and releaseably disengaging the door 62 from the side wall 14, 16, 18, 20 in an unlocked condition to allow pivotal movement of the door 62 relative to the side wall 14, 16, 18, 20. The door locking means 68 as shown in FIG. 11 is similar to the wall locking means 42. The door locking means 68 includes a latch member 70 mounted on the door 62 and having projections 72 extending outwardly from one side thereof and slideably disposed in a groove 74 of the opening 60. The projections 72 are biased outwardly from the door 62 and into engagement with the groove 74 by a biasing means 73 such as a spring. The spring 73 is disposed between the door 62 and the latch member 70 and exerts a force on the latch member 70 to urge the projections 72 outward. The projection 72 include a chamfer 75 on its inward side nearest to the inside of the container assembly (10) and a flat side 77 which extends parallel to the side wall of the groove 74. Both the chamfer 75 and the flat side 77 are disposed at the distal end of the projection 72 and opposite one another. When the door 62 is in the vertical, upright, closed and locked position, the door may only be opened by manually disengaging the door locking means 68. This may occur by pulling the latch member 70 to place the spring 73 in further compression until the projection 72 has been retracted out of the groove 74. The door 62 may then be opened. However, closing the door 62 requires only that the door be shut with a sufficient force to drive the projection 72 into retraction when the chamfer 75 of the projection 72 comes into contact with the opening 60. Said another way, the door locking means 68 includes a snap-in feature attendant upon closing the door 62 but not upon opening the door 62. The chamfer facilitates the automatic retraction of the projection 72 upon closing the door 62 without manual manipulation of the latch member 70. After the projection 72 has been retracted and the door 62 placed in the fully upright and closed position, the projection 72 is urged into the groove 74 by the spring 73. Preferably, the door 62 includes a door latch member 70 on each side of the door 62 and a adjacent groove 74 along each side of the opening 60. The disposition of the latch member 70 on either side of the door 62 allows an operator to unlock the door 62 and control the door 62 as it opens without need to readjust or remove his grip on the door. Said another way, if the latch 70 was disposed on a side wall 14, 16, 18, 20 contrary to the subject invention, and the groove 74 located in the door 62, when an operator unlocked the door 62 by manipulating the latch member 70, the door would fall open freely and possibly strike the operator. The operator is less likely to control the door as it opens because his hands are located on the latch 70 of the side wall 14, 16, 18, 20 and not on the door 62 of the present invention. The present invention avoids this occurrence. The operation of the door locking means 68 is similar to the wall locking means 42. The opening 60 includes a flange 76 acting as a stop to prevent pivotal movement of the door 62 past the side wall 14, 16, 18, 20 to the inside of the container assembly 10.

The base 12 of the assembly 10 is generally convexed with respect to a flat support surface. Said another way, the base 12 is not generally flat or substantially parallel to a flat planner support surface. The base 12 includes a rigid top member 80 and a support means, generally indicated at 82, connected to the top member 80 for supporting the top member 80 upon a support surface and defining channels 84 therein for guiding the forks of a lifting means such as a forked lift into the channels 84 and for inserting the base 12 within the perimeter or opening formed by the side walls 14, 16, 18, 20 in the vertical position of another assembly 10 to allow vertical stacking of the container assemblies one upon another. The support means 82 includes a corner support member 86 at each of the four corners of the top member 80 and a perimeter support element 88 near the perimeter of the top member 80 about midway between adjacent pairs of corner support elements 86, and a center support element 90 near the center of the top member 80. In other words, support elements 86, 88, and 90 are similar to legs extending downwardly from the top member 80 to space the top member 80 from a support surface. The support means 82 includes a spacer means, generally indicated at 92, for integrally interconnecting the corner support elements 86 and the perimeter support elements 88 and the center support element 90 to form a bottom member similar to the top member 80. Hence, the base 12 is similar to a pallet. The spacer means 92 structurally reinforces and supports the support elements 86, 88, 90 and forms a bottom member. Said another way, the spacer means 92 interconnects a corner support element 86 with a perimeter support element 88 and a center support element 90 with the perimeter support element 88 to form a bottom member substantially similar to the top member. The spacer means 92 includes a strip member 94 being defined as a plate. The strip member 94 is substantially the same width as the support elements 86, 88, and 90 to form four rectangular-like openings in the bottom member. Both the top member 80 and strip member 94 include longitudinal slots 96 therein. The strip member 94 includes a flange 98 along one edge thereof extending downwardly and outwardly from the strip member 94 for abutting the interior edge of the side walls 14, 16, 18, 20 when the side walls 14, 16, 18, 20 are in the vertical position for vertically stacking the container assemblies 10 one upon another. In other words, the flange 98 of the strip member 94 forms a perimeter similar to the opening formed when the side walls 14, 16, 18, 20 are in the vertical position so that the flange 98 fits inside the opening to prevent movement of the container assembly 10 when vertically stacking the container assemblies 10 upon one another. Accordingly, any combination of folded and unfolded containers may be stacked upon one another.

The corner support element 86 and the perimeter support element 88 define a pair of forked channels 84 for receiving and guiding the forks of a forked lift for mechanically raising and lowering the container assembly 10. The corner support elements 86 and the perimeter support elements 88 each have planner exterior side surfaces 100 along the perimeter of the top member 80 and parallel interior surfaces 102 extending diagonally inwardly from the exterior side surfaces 100 to guide the forks of the forked lift in the channels 84. The flange 98 includes a chamfer 104 to guide the forks of the forked lift upwardly into the channels 84. However, when the door 62 is in the fully open position, the door partially blocks the channels 84 and thereby prevents the container assembly 10 from being moved when the door is in the open position.

Accordingly, any combination of folded and unfolded containers may be stacked upon one another.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A foldable container assembly (10) comprising: a base (12) having a plurality of sides walls (14,16,18,20) extending vertically upward from each side of said base (12) at least one of said walls (14,16,18,20) including an opening (60) therein, said opening (60) including an open-ended top side, a horizontal bottom side, a pair of vertical sides extending from said open-ended top side to a point between said open-ended top side and said horizontal bottom side of said opening (60) and a pair of inwardly angled sides extending from the point between said top side and said bottom side of said opening (60) and which terminates and forms an intersection at said horizontal bottom side and characterized by a pair of ribs forming an apex at the intersection of said inwardly angled side and said downwardly bottom side of said opening (60), said pair of ribs diverging from said apex and terminating at the bottom of said side walls (14,16,18,20) and for increasing the structural integrity of said opening (60) and for providing strength to said container (10) at a crucial, load-bearing area.

2. The container (10) as set forth in claim 1 further characterized by a pair of diagonal ribs extending outwardly from the intersection of said vertical side and said inwardly extending sides of said opening (60) at the point between said top side and said bottom side of said opening (60) and the outside edge of said side walls (14,16,18,20) for increasing the structural integrity of said opening (60) and for providing strength to said container (10) at the intersection of said vertical side and said inwardly extending side of said opening (60) at the point between said top side and said bottom side of said opening (60).

3. A foldable container assembly (10) comprising:

a base (12) having a plurality of sides, at least one side wall (14,16,18,20) extending vertically upward from each side of said base (12) and including wall hinge means (24) interconnecting each of said side walls (14,16,18,20) to said base (12);

locking means (42,68) disposed on said container assembly (10) for releasably locking one portion of the container assembly (10) to the side edge of an adjacent side wall when in the vertical position;

said locking means (42,68) including a fixed member mounted to said container assembly (10) and a latch member (44,70) slideably moveable with respect to said fixed member between latched and unlatched positions with respect to an adjacent side wall (14,16,18,20), said latch member (44,70) including a latch flange extending away from said container assembly (10) at one end of said latch member (44,70) for engagement by an operator for moving said latch member (44,70) from said latched to said unlatched position and a stop flange extending inwardly toward said container assembly (10) and at the opposite end of said latch member (44,70) to limit the travel of said latch member (44,70) with respect to said fixed member in said latched position, said fixed member including a base flange extending away from said container assembly (10) and in parallel spaced relationship with respect to said stop flange to define a cavity portion therebetween;

said assembly characterized by including a biasing means (52,73) disposed within said cavity portion and acting between said base flange of said fixed member and said stop flange of said latch member (44,70) to bias said latch member (44,70) to said latched position with respect to said adjacent side walls (14,16,18,20).

4. A foldable container assembly (10) comprising;

a base (12) having a plurality of sides, at least one side wall (14,16,18,20) extending vertically upward from each side of said base (12) and including wall hinge means (24) interconnecting each of said side walls (14,16,18,20) to said base (12);

wall locking means (42) for releaseably locking the side edge of each side wall (14,16,18,20) to the side edge of an adjacent side wall when in the vertical position;

said wall locking means (42) including a fixed member mounted to at least one edge of said side wall (14,16,18,20) and a latch member (44) slideably moveable with respect to said fixed member between latched and unlatched positions with respect to an adjacent side wall (14,16,18,20), said latch member (44) including a latch flange (54) extending away from said side wall (14,16,18,20) at one end of said latch member (44) for engagement by an operator for moving said latch member (44) from said latch to said unlatched position and a stop flange extending inwardly toward said side walls (14,16,18,20) and at the opposite end of said latch member (44) to limit the travel of said latch member (44) with respect to said fixed member and in said latched position, said fixed member including a base flange extending away from said side walls (14,16,18,20) and in parallel spaced relationship with respect to said stop flange to define a cavity portion (50) therebetween;

said assembly characterized by including a biasing means (52) disposed within said cavity portion (50) and acting between said base flange of said fixed member and said stop flange of said latch member (44) to bias said latch member (44) to said latched position with respect to said adjacent side walls (14,16,18,20).

5. An assembly (10) as set forth in claim 4 further characterized by said wall locking means (42) including a longitudinal groove (48) in the edge of an adjacent side wall (14,16,18,20) said latch member (44) having a projection (46) extending outwardly from the terminal end thereof opposite said latch flange (54), said projection (46) being slideably disposed in said groove (48) when said side wall (14,16,18,20) is in the vertical locked position.

6. An assembly as set forth in claim 5 further characterized by said projection (46) including a chamfer disposed on the distal end of said projection (46), said biasing means (52) and said chamfer on said projection (46) allowing said side wall (14,16,18,20) to be moved from a collapsed position and snapped into an upright position without manual manipulation of said latch member (44) from said latched to said unlatched position by movement of said latch flange (54) of said wall locking means (42).

7. An assembly as set forth in claim 6 further characterized by said side walls (14,16,18,20) having planar interior sheet (38) and the ribs (46) extending outwardly therefrom and in spaced relationship with respect to each other to form a plurality of recesses in said side walls (14,16,18,20), said fixed member of said wall latching means (42) mounted flush to said planar sheet (38) within one of said recesses.

8. A foldable container assembly (10) comprising;

a base (12) having a plurality of sides, side walls (14,16,18,20) extending vertically upward from each side of said base (12) and including wall hinge means (24) interconnecting each of said side walls (14,16,18,20) to said base (12), at least one of said side walls (14,16,18,20) including an opening (60) therein, and including a door (62) disposed in said opening (60) of said side walls (14,16,18,20) for opening an closing said opening (60) to allow axis to the inside of the container assembly (10) through said side walls (14,16,18,20) when said side walls (14,16,18,20) are in the vertical position;

door locking means (68) disposed on said door (62) for releaseably engaging said door (62) with said side walls (14,16,18,20) in a locked position to prevent pivotal movement of said door (62) relative to said side walls (14,16,18,20) and releaseably disengaging said door (62) from said side walls (14,16,18,20) in an unlocked position to allow pivotal movement of said door (62) relative to said side walls (14,16,18,20);

said door locking means (68) including a fixed member mounted to at least one edge of said door (62) and a latch member (70) slideably moveable with respect to said fixed member between latched and unlatched positions with respect to an adjacent side wall (14,16,18,20), said latch member (70) including a latch flange extending away from said door (62) at one end of said latch member (70) for engagement by an operator for moving said latch member (70) from said latched to said unlatched position and a stop flange extending inwardly toward said door (62) and at the opposite end of said latch member (70) to limit the travel of said latch member (70) with respect to said fixed member and in said latched position, said fixed member including a base flange extending away from said door (62) and in parallel space relationship with respect to said stop flange to define a cavity portion therebetween;

said assembly characterized by including biasing means (73) disposed within said cavity portion and acting between said base flange of said fixed member and said stop flange of said latch member (70) to bias said latch member (70) to said latched position with respect to said adjacent side walls (14,16,18,20).

9. An assembly (10) as set forth in claim 8 further characterized by said door locking means (68) including a longitudinal groove (74) in the edge of an adjacent side wall (14,16,18,20), said latch member (70) having a projection (72) extending outwardly from the terminal end thereof opposite said latch flange, said projection (72) being slideably disposed in said groove (74) when said door (62) is in the vertical locked position.

10. An assembly as set forth in claim 9 further characterized by said projection (72) including a chamfer (75) disposed on the distal end of said projection (72), said biasing means (73) and said chamber (75) on said projection (72) allowing said door (62) to be moved from an open position and snapped into an upright closed position without manual manipulation of said latch member (70) from said latch to said unlatched position by movement of said latch flange of said door locking means (68).

11. An assembly (10) as set forth in claim 10 further characterized by said door (62) having planar interior sheets and ribs extending outwardly therefrom and in spaced relationship with respect to each other to form a plurality of recesses in said door (62), said fixed member of said door locking means (68) mounted flush to said planar sheets within one of said recesses.

* * * * *